US009551130B2

(12) United States Patent
Hendron et al.

(10) Patent No.: US 9,551,130 B2
(45) Date of Patent: Jan. 24, 2017

(54) BLADE STABILIZATION SYSTEM AND METHOD FOR A WORK VEHICLE

(71) Applicant: Deere & Company, Moline, IL (US)

(72) Inventors: Scott S. Hendron, Dubuque, IA (US); Chris J. McDonald, Dubuque, IA (US); Bryan Rausch, Durango, IA (US); Travis Wiens, Saskatoon (CA); Jeff Dobchuk, Saskatoon (CA)

(73) Assignee: DEERE & COMPANY, Moline, IL (US)

( * ) Notice: Subject to any disclaimer, the term of this patent is extended or adjusted under 35 U.S.C. 154(b) by 142 days.

(21) Appl. No.: 14/614,632

(22) Filed: Feb. 5, 2015

(65) Prior Publication Data

US 2016/0230366 A1 Aug. 11, 2016

(51) Int. Cl.
*E02F 3/84* (2006.01)
*E02F 3/76* (2006.01)

(52) U.S. Cl.
CPC ..... *E02F 3/844* (2013.01); *E02F 3/7618* (2013.01)

(58) Field of Classification Search
CPC ..... E02F 3/7618; E02F 3/844; E02F 3/845; E02F 3/847
USPC ..... 172/4, 4.5, 779, 818, 819
See application file for complete search history.

(56) References Cited

U.S. PATENT DOCUMENTS 2,941,319 A 6/1960 Beemer et al.
4,535,847 A 8/1985 Hasegawa et al.
5,462,125 A 10/1995 Stratton et al.
5,499,684 A 3/1996 Stratton
5,551,518 A 9/1996 Stratton
5,816,335 A * 10/1998 Yamamoto ..... E02F 3/845 172/3
5,862,868 A 1/1999 Yamamoto et al.
5,987,371 A 11/1999 Bailey et al.
6,035,241 A 3/2000 Yamamoto
6,112,145 A 8/2000 Zachman
6,164,117 A 12/2000 Passwater et al.
(Continued)

FOREIGN PATENT DOCUMENTS

EP 1118719 A2 7/2001

OTHER PUBLICATIONS

Earthmoving Report: Cat K2 Dozers Offer Finely Tuned Finish Grading. Earthmoving Report [online]. Feb. 28, 2012. [retrieved on May 19, 2014] http://www.constructionequipment.com/earthmoving-report-cat-K2-dozers-offer-finely-tuned-finish-grading.
(Continued)

*Primary Examiner* — Gary Hartmann

(57) ABSTRACT

A work vehicle may include a chassis, a ground-engaging blade, a sensor, and a controller. The ground-engaging blade may be movably connected to the chassis via a linkage configured to allow the blade to be raised or lowered relative to the chassis. The sensor may be connected to the chassis at a fixed relative position to the chassis and configured to provide a pitch signal indicative of a rotational velocity in a pitch direction. The controller may be configured to receive the pitch signal and send a command to raise or lower the blade, the command based on a first gain and the pitch signal when the pitch signal indicates a rotational velocity in a first direction and based on a second gain and the pitch signal when the pitch signal indicates a rotational velocity in a second direction.

8 Claims, 6 Drawing Sheets

(56) References Cited

U.S. PATENT DOCUMENTS

| | | | | |
|---|---|---|---|---|
| 6,181,999 | B1 * | 1/2001 | Yamamoto | E02F 3/844 172/4.5 |
| 6,269,885 | B1 | 8/2001 | Barber et al. | |
| 6,609,315 | B1 | 8/2003 | Hendron et al. | |
| 6,757,994 | B1 | 7/2004 | Hendron | |
| 6,763,619 | B2 | 7/2004 | Hendron et al. | |
| 6,845,311 | B1 * | 1/2005 | Stratton | E02F 3/847 340/870.16 |
| 7,121,355 | B2 | 10/2006 | Lumpkins et al. | |
| 7,206,681 | B2 | 4/2007 | Casey et al. | |
| 7,317,977 | B2 | 1/2008 | Matrosov | |
| 7,588,088 | B2 | 9/2009 | Zachman | |
| 7,643,923 | B2 | 1/2010 | Buehlmann et al. | |
| 8,060,299 | B2 | 11/2011 | Gharsalli et al. | |
| 8,082,084 | B2 | 12/2011 | Nichols | |
| 8,141,650 | B2 | 3/2012 | Breiner et al. | |
| 8,145,391 | B2 | 3/2012 | Omelchenko et al. | |
| 8,275,524 | B2 | 9/2012 | Krause et al. | |
| 8,340,873 | B2 | 12/2012 | Finley et al. | |
| 8,352,132 | B2 | 1/2013 | Omelchenko et al. | |
| 8,406,963 | B2 | 3/2013 | Farmer et al. | |
| 8,412,418 | B2 | 4/2013 | Kumagai et al. | |
| 8,437,926 | B2 * | 5/2013 | Shintani | E02F 3/844 172/4.5 |
| 8,473,166 | B2 | 6/2013 | Zhdanov et al. | |
| 8,594,879 | B2 | 11/2013 | Roberge et al. | |
| 8,634,991 | B2 | 1/2014 | Douglas | |
| 8,700,273 | B2 * | 4/2014 | Farmer | E02F 3/845 172/10 |
| 8,706,363 | B2 * | 4/2014 | Stratton | E02F 9/2045 144/4.1 |
| 8,738,242 | B2 * | 5/2014 | Konno | E02F 3/845 172/25 |
| 8,919,455 | B2 | 12/2014 | Hendron et al. | |
| 2008/0087447 | A1 | 4/2008 | Piekutowski | |
| 2008/0127530 | A1 | 6/2008 | Kelly | |
| 2009/0112410 | A1 | 4/2009 | Shull | |
| 2011/0153170 | A1 | 6/2011 | Dishman et al. | |
| 2011/0169949 | A1 | 7/2011 | McCain et al. | |
| 2011/0213529 | A1 | 9/2011 | Krause et al. | |
| 2012/0059554 | A1 | 3/2012 | Omelchenko et al. | |
| 2012/0073843 | A1 * | 3/2012 | Kure | B62D 55/084 172/407 |
| 2013/0080112 | A1 | 3/2013 | Friend | |
| 2013/0158818 | A1 | 6/2013 | Callaway | |
| 2014/0019013 | A1 | 1/2014 | Liu et al. | |
| 2014/0326471 | A1 * | 11/2014 | Zhu | E02F 3/764 172/4.5 |

OTHER PUBLICATIONS

Cat |New Cat® D6K2 Track—Type Tractor Offers Refined Blade Control and Enhanced . . . [online]. Apr. 2014. [retrieved on May 19, 2014] http://www.cat.com/en GB/news/press-release/new-cat-d6k2-tracktypetractoroffersrefine.

* cited by examiner

BLADE STABILIZATION SYSTEM AND METHOD FOR A WORK VEHICLE

FIELD OF THE DISCLOSURE

The present disclosure relates to machine. An embodiment of the present disclosure relates to a system and method for stabilizing a ground-engaging blade of a work vehicle.

BACKGROUND

Work vehicles with ground-engaging blades may be used to shape and smooth ground surfaces. Such work vehicles may be supported by wheels or tracks which may encounter raised and lowered features on the ground as the work vehicles move, which cause the work vehicle to pitch forwards (downwards) or backwards (upwards). This pitching may be transmitted to the ground-engaging blade, causing it to move upwards and downwards and create unintended vertical variations on the ground surface instead of a smooth surface. This effect may be amplified for those work vehicles with a ground engaging blade in front of the work vehicles' tires or tracks, as unintended pitching of the vehicle may cause the blade to create ground variations which then cause further unintended pitching when encountered by the tires and tracks. If this self-reinforcing effect goes uncorrected by an operator, it may create a "washboard" type surface on the ground.

SUMMARY

According to an aspect of the present disclosure, a work vehicle may include a chassis, a ground-engaging blade, a sensor, and a controller. The ground-engaging blade may be movably connected to the chassis via a linkage configured to allow the blade to be raised or lowered relative to the chassis. The sensor may be connected to the chassis at a fixed relative position to the chassis and configured to provide a pitch signal indicative of a rotational velocity in a pitch direction. The controller may be configured to receive the pitch signal and send a command to raise or lower the blade, the command may be based on a first gain and the pitch signal when the pitch signal indicates a rotational velocity in a first direction and a second gain and the pitch signal when the pitch signal indicates a rotational velocity in a second direction.

According to another aspect of the present disclosure, the command may be based on a pitch-command relationship which is based on kinematics of the linkage.

According to another aspect of the present disclosure, the work vehicle may further include a hydraulic cylinder and a hydraulic valve. The hydraulic cylinder may be connected to the linkage and configured to raise or lower the blade when provided with hydraulic fluid from the hydraulic valve. The command may be based on a pitch-command relationship which is based on a relationship between the command and a flow rate from the hydraulic valve to the hydraulic cylinder.

According to another aspect of the present disclosure, the controller may be further configured so that the first direction refers to when the chassis is pitching forward and the second direction refers to when the chassis is pitching backward. The magnitude of the first gain may be greater than the magnitude of the second gain.

According to another aspect of the present disclosure, the work vehicle may include ground-engaging tracks connected to the chassis. The ratio of the first gain to the second gain may be substantially the same as a ratio of a longitudinal distance from a rearmost ground-engaging portion of the tracks to the blade to a longitudinal distance from the center of gravity of the work vehicle to the blade.

According to another aspect of the present disclosure, the work vehicle may include ground-engaging tracks connected to the chassis. The ratio of the first gain to the second gain may be between 80% and 120% of a ratio of a longitudinal distance from the rearmost portion of the tracks engaged with the ground to the blade to a longitudinal distance from the center of gravity of the work vehicle to the blade.

According to another aspect of the present disclosure, the command is not based on a signal from a sensor connected at a fixed relative position to the blade and indicative of a position or a rotational velocity of the blade.

According to another aspect of the present disclosure, the work vehicle may include a blade sensor connected to the blade at a fixed relative position to the blade and configured to provide a position signal indicative of a vertical position of the blade or an angle of the blade relative to the direction of gravity. The command may be based on the position signal, the first gain, and the pitch signal when the pitch signal indicates a rotational velocity in a first direction and the command may be based on the position signal, the second gain, and the pitch signal when the pitch signal indicates a rotational velocity in a second direction.

According to another aspect of the present disclosure, a method of controlling a work vehicle with a ground-engaging blade may include receiving a pitch signal indicative of a rotational velocity of a chassis of the work vehicle in a pitch direction and determining a command signal which will counteract the effect of the rotational velocity of the chassis on the ground-engaging blade connected to the work vehicle based on a first gain and the pitch signal if the pitch signal indicates a rotational velocity in a first direction and based on a second gain and the pitch signal if the pitch signal indicates a rotational velocity in a second direction.

According to another aspect of the present disclosure, the first direction may be the chassis pitching forward and the second direction may be the chassis pitching backward. The magnitude of the first gain may be greater than the magnitude of the second gain.

According to another aspect of the present disclosure, the ratio of the first gain to the second gain may be substantially the same as a ratio of a longitudinal distance from a rearmost ground-engaging portion of chassis-connected tracks to the blade to a longitudinal distance from the center of gravity of the work vehicle to the blade.

According to another aspect of the present disclosure, the ratio of the first gain to the second gain may be between 80% and 120% of a ratio of a longitudinal distance from a rearmost ground-engaging portion of chassis-connected tracks to the blade to a longitudinal distance from the center of gravity of the work vehicle to the blade.

According to another aspect of the present disclosure, the determining step may not be based on a signal from a sensor connected to the blade at a fixed relative position to the blade and indicative of a position or a rotational velocity of the blade.

According to another aspect of the present disclosure, a work vehicle may include a chassis, a ground-engaging blade, a hydraulic cylinder, an electrohydraulic valve assembly, a rotational velocity sensor, and a controller. The ground-engaging blade may be movably connected to the chassis via a linkage configured to allow the blade to be raised and lowered relative to the chassis. The hydraulic cylinder may be connected to the linkage and configured to raise and lower the blade. The electrohydraulic valve assembly may be hydraulically connected to the hydraulic cylinder and configured to actuate the hydraulic cylinder. The rotational velocity sensor may be connected to the chassis and configured to provide a pitch signal indicative of a rotational velocity of the sensor in a pitch direction. The controller may be configured to receive the pitch signal, determine a command signal based on a first gain and the pitch signal if the pitch signal indicates a rotational velocity in a first direction and based on a second gain and the pitch signal if the pitch signal indicates a rotational velocity in a second direction, and communicate the command signal to the electrohydraulic valve assembly.

According to another aspect of the present disclosure, the work vehicle may include a position sensor. The position sensor may be connected to the linkage at a fixed relative position to the linkage. The position sensor may be configured to provide a position signal indicative of a position or an angle of at least one member of the linkage. The command signal may be based on the position signal.

According to another aspect of the present disclosure, the work vehicle may include a position sensor. The position sensor may be connected to the blade at a fixed relative position to the blade. The position sensor may be configured to provide a position signal indicative of a position or an angle of the blade. The command signal may be based on the position signal.

According to another aspect of the present disclosure, the first direction may be the chassis pitching forward. The second direction may be the chassis pitching backward. The magnitude of the first gain may be greater than the magnitude of the second gain.

According to another aspect of the present disclosure, the work vehicle may include ground-engaging tracks connected to the chassis. The ratio of the first gain to the second gain may be substantially the same as a ratio of a longitudinal distance from a rearmost ground-engaging portion of the tracks to the blade to a longitudinal distance from the center of gravity of the work vehicle to the blade.

According to another aspect of the present disclosure, the work vehicle may include ground-engaging tracks connected to the chassis. The ratio of the first gain to the second gain may be between 80% and 120% of a ratio of a longitudinal distance from the rearmost portion of the tracks engaged with the ground to the blade to a longitudinal distance from the center of gravity of the work vehicle to the blade.

According to another aspect of the present disclosure, the command signal is not based on a signal from a sensor connected to the blade at a fixed relative position to the blade and indicative of a position or a rotational velocity of the blade.

According to another aspect of the present disclosure, the work vehicle may be a crawler dozer.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
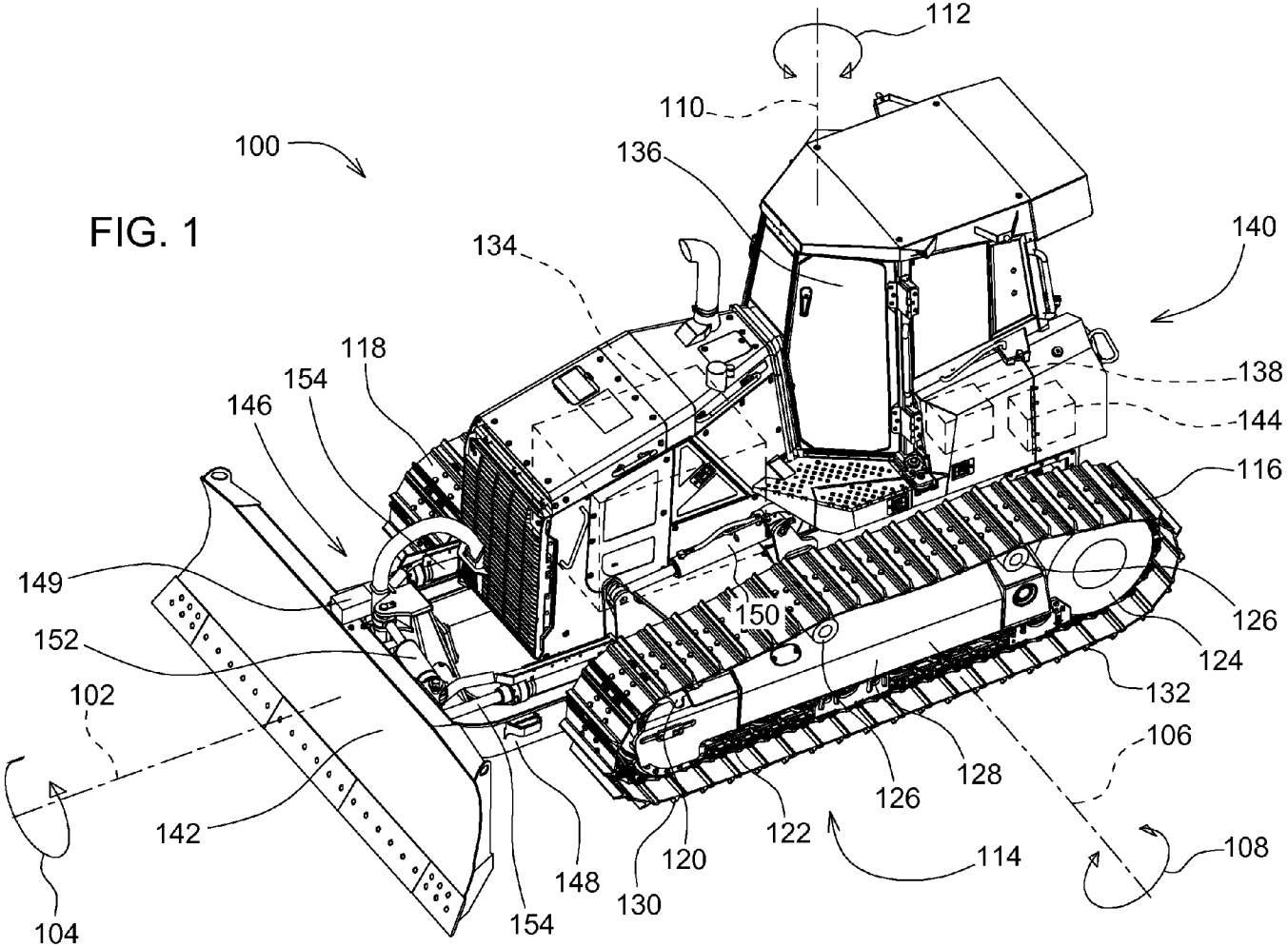
FIG. 1 is a perspective work of a work vehicle, for example a crawler dozer.

FIG. 1 is a perspective view of work vehicle 100. Work vehicle 100 is illustrated as a crawler dozer, which may also be referred to as a crawler, but may be any work vehicle with a ground-engaging blade or work implement such as a compact track loader, motor grader, scraper, skid steer, and tractor, to name a few examples. Work vehicle 100 may be operated to engage the ground and cut and move material to achieve simple or complex features on the ground. As used herein, directions with regard to work vehicle 100 may be referred to from the perspective of an operator seated within operator station 136: the left of work vehicle 100 is to the left of such an operator, the right of work vehicle 100 is to the right of such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator. Directions for work vehicle 100 may also be referred to with regard to longitude 102 or the longitudinal direction, latitude 106 or the lateral direction, and vertical 110 or the vertical direction. Rotation for work vehicle 100 may be referred to as roll 104 or the roll direction, pitch 108 or the pitch direction, and yaw 112 or the yaw direction or the heading.

Work vehicle 100 is supported on the ground by undercarriage 114. Undercarriage 114 includes left track 116 and right track 118, which engage the ground and provide tractive force for work vehicle 100. Left track 116 and right track 118 may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of work vehicle 100, provide support for work vehicle 100 on the ground. Front idlers 120, track rollers 122, rear sprockets 124, and top idlers 126 are all pivotally connected to the remainder of work vehicle 100 and rotationally coupled to their respective tracks so as to rotate with those tracks. Track frame 128 provides structural support to these components and the remainder of undercarriage 114.

Front idlers 120 are positioned at the longitudinal front of left track 116 and right track 118 and provide a rotating surface for the tracks to rotate about and a support point to transfer force between work vehicle 100 and the ground. Left track 116 and right track 118 rotate about front idlers 120 as they transition between their vertically lower and vertically upper portions parallel to the ground, so approximately half of the outer diameter of each of front idlers 120 is engaged with left track 116 or right track 118. This engagement may be through a sprocket and pin arrangement, where pins included in left track 116 and right track 118 are engaged by recesses in front idlers 120 so as to transfer force. This engagement also results in the vertical height of left track 116 and right track 118 being only slightly larger than the outer diameter of each of front idlers 120 at the longitudinal front of left track 116 and right track 118. Frontmost engaging point 130 of left track 116 and right track 118 can be approximated as the point on each track vertically below the center of front idlers 120, which is generally the frontmost point of left track 116 and right track 118 which engages the ground. When work vehicle 100 encounters a ground feature when traveling in a forward direction, left track 116 and right track 118 may first encounter it at frontmost engaging point 130. If the ground feature is at a higher elevation than the surrounding ground surface (i.e., an upward ground feature), work vehicle 100 may begin pitching backward (which may also be referred to as pitching upward) when frontmost engaging point 130 reaches the ground feature. If the ground feature is at a lower elevation than the surrounding ground surface (i.e., a downward ground feature), work vehicle 100 may continue forward without pitching until the center of gravity of work vehicle 100 is vertically above the edge of the downward ground feature. At that point, work vehicle 100 may pitch forward (which may also be referred to as pitching downward) until frontmost engaging point 130 contacts the ground. In this embodiment, front idlers 120 are not powered and thus are freely driven by left track 116 and right track 118. In alternative embodiments, front idlers 120 may be powered, such as by an electric or hydraulic motor, or may have an included braking mechanism configured to resist rotation and thereby slow left track 116 and right track 118.

Track rollers 122 are longitudinally positioned between front idlers 120 and rear sprockets 124 along the bottom left and bottom right sides of work vehicle 100. Each of track rollers 122 may be rotationally coupled to left track 116 or right track 118 through engagement between an upper surface of the tracks and a lower surface of track rollers 122. This configuration may allow track rollers 122 to provide support to work vehicle 100, and in particular may allow for the transfer of forces in the vertical direction between work vehicle 100 and the ground. This configuration also resists the upward deflection of left track 116 and right track 118 as they traverse an upward ground feature whose longitudinal length is less than the distance between front idlers 120 and rear sprockets 124.

Rear sprockets 124 may be positioned at the longitudinal rear of left track 116 and right track 118 and, similar to front idlers 120, provide a rotating surface for the tracks to rotate about and a support point to transfer force between work vehicle 100 and the ground. Left track 116 and right track 118 rotate about rear sprockets 124 as they transition between their vertically lower and vertically upper portions parallel to the ground, so approximately half of the outer diameter of each of rear sprockets 124 is engaged with left track 116 or right track 118. This engagement may be through a sprocket and pin arrangement, where pins included in left track 116 and right track 118 are engaged by recesses in rear sprockets 124 so as to transfer force. This engagement also results in the vertical height of left track 116 and right track 118 being only slightly larger than the outer diameter of each of rear sprockets 124 at the longitudinal back or rear of left track 116 and right track 118. Rearmost engaging point 132 of left track 116 and right track 118 can be approximated as the point on each track vertically below the center of rear sprockets 124, which is generally the rearmost point of left track 116 and right track 118 which engages the ground. When work vehicle 100 encounters a ground feature when traveling in a reverse or backward direction, left track 116 and right track 118 may first encounter it at rearmost engaging point 132. If the ground feature is at a higher elevation than the surrounding ground surface, work vehicle 100 may begin pitching forward when rearmost engaging point 132 reaches the ground feature. If the ground feature is at a lower elevation than the surrounding ground surface, work vehicle 100 may continue backward without pitching until the center of gravity of work vehicle 100 is vertically above the edge of the downward ground feature. At that point, work vehicle 100 may pitch backward until rearmost engaging point 132 contacts the ground.

In this embodiment, each of rear sprockets 124 may be powered by a rotationally coupled hydraulic motor so as to drive left track 116 and right track 118 and thereby control propulsion and traction for work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by engine 134 of work vehicle 100, and may be controlled by an operator in operator station 136 issuing commands which may be received by controller 138 and communicated to the left and right hydrostatic pumps by controller 138. In alternative embodiments, each of rear sprockets 124 may be driven by a rotationally coupled electric motor or a mechanical system transmitting power from engine 134.

Top idlers 126 are longitudinally positioned between front idlers 120 and rear sprockets 124 along the left and right sides of work vehicle 100 above track rollers 122. Similar to track rollers 122, each of top idlers 126 may be rotationally coupled to left track 116 or right track 118 through engagement between a lower surface of the tracks and an upper surface of top idlers 126. This configuration may allow top idlers 126 to support left track 116 and right track 118 for the longitudinal span between front idlers 120 and rear sprockets 124, and prevent downward deflection of the upper portion of left track 116 and right track 118 parallel to the ground between front idlers 120 and rear sprockets 124.

Undercarriage 114 is affixed to, and provides support and tractive effort for, chassis 140 of work vehicle 100. Chassis 140 is the frame which provides structural support and rigidity to work vehicle 100, allowing for the transfer of force between blade 142 and left track 116 and right track 118. In this embodiment, chassis 140 is a weldment comprised of multiple formed and joined steel members, but in alternative embodiments it may be comprised of any number of different materials or configurations. Sensor 144 is affixed to chassis 140 of work vehicle 100 and configured to provide a signal indicative of the movement and orientation of chassis 140. In alternative embodiments, sensor 144 may not be affixed directly to chassis 140, but may instead be connected to chassis 140 through intermediate components or structures, such as rubberized mounts. In these alternative embodiments, sensor 144 is not directly affixed to chassis 140 but is still connected to chassis 140 at a fixed relative position so as to experience the same motion as chassis 140.

Sensor 144 is configured to provide a signal indicative of the angular velocity of chassis 140 in the direction of pitch 108. This signal may be referred to as a pitch signal. Controller 138 may actuate blade 142 based on this pitch signal, as further described with regard to FIG. 2, FIG. 3, FIG. 4, FIG. 5, and FIG. 6. As used herein, "based on" means "based at least in part on" and does not mean "based solely on," such that it neither excludes nor requires additional factors. Sensor 144 may also be configured to provide a signal or signals indicative of other positions or velocities of chassis 140, including its inclination (i.e., an angle or orientation of chassis 140 relative to the direction of gravity), its angular velocity or angular acceleration in a direction such as the direction of roll 104, pitch 108, yaw 112, or its linear velocity or linear acceleration in a direction such as the direction of longitude 102, latitude 106, and vertical 110. Sensor 144 may be configured to directly measure angular velocity, measure angular acceleration and integrate to arrive at angular velocity, or measure angular position (e.g., inclination with respect to gravity) and derive angular velocity. The placement of sensor 144 on chassis 140 instead of on blade 142 or linkage 146 may allow sensor 144 to be better protected from damage, more firmly affixed to work vehicle 100, more easily packaged, or more easily integrated into another component of work vehicle 100 such as controller 138. This placement may allow for sensor 144 to be more cost effective, durable, reliable, or accurate than if sensor 144 were placed on blade 142 or linkage 146, even though placing sensor 144 directly on blade 142 or linkage 146 (such as sensor 149) may allow for a more direct reading of a position, velocity, or acceleration of those components.

Blade 142 is a work implement which may engage the ground or material to move or shape it. Blade 142 may be used to move material from one location to another and to create features on the ground, including flat areas, grades, hills, roads, or more complexly shaped features. In this embodiment, blade 142 of work vehicle 100 may be referred to as a six-way blade, six-way adjustable blade, or power-angle-tilt (PAT) blade. Blade 142 may be hydraulically actuated to move vertically up or vertically down (which may also be referred to as blade lift, or raise and lower), roll left or roll right (which may be referred to as blade tilt, or tilt left and tilt right), and yaw left or yaw right (which may be referred to as blade angle, or angle left and angle right). Alternative embodiments may utilize a blade with fewer hydraulically controlled degrees of freedom, such as a 4-way blade that may not be angled, or actuated in the direction of yaw 112.

Blade 142 is movably connected to chassis 140 of work vehicle 100 through linkage 146, which supports and actuates blade 142 and is configured to allow blade 142 to be raised or lowered relative to chassis 140 (i.e., moved in the direction of vertical 110). Linkage 146 may include multiple structural members to carry forces between blade 142 and the remainder of work vehicle 100 and may provide attachment points for hydraulic cylinders which may actuate blade 142 in the lift, tilt, and angle directions.

Linkage 146 includes c-frame 148, a structural member with a C-shape positioned rearward of blade 142, with the C-shape opening toward the rear of work vehicle 100. Each rearward end of c-frame 148 is pivotally connected to chassis 140 of work vehicle 100, such as through a pin-bushing joint, allowing the front of c-frame 148 to be raised or lowered relative to work vehicle 100 about the pivotal connections at the rear of c-frame 148. The front portion of c-frame 148, which is approximately positioned at the lateral center of work vehicle 100, connects to blade 142 through a ball-socket joint. This allows blade 142 three degrees of freedom in its orientation relative to c-frame 148 (lift-tilt-angle) while still transferring rearward forces on blade 142 to the remainder of work vehicle 100.

Sensor 149 is connected to blade 142 above the ball-socket joint connecting blade 142 to c-frame 148. Sensor 149, like sensor 144, may be configured to measure orientation, angular velocity, or acceleration. Sensor 149 is an optional component which may be used in certain embodiments to directly sense an angular or linear position, velocity, or acceleration of blade 142. In alternative embodiments, a sensor may be configured to instead measure an angle of linkage 146, such as an angle between linkage 146 and chassis 140, in order to determine a position of blade 142. In other alternative embodiments, sensor 149 may be configured to measure a position of blade 142 by measuring a different angle, such as one between linkage 146 and blade 142, or the linear displacement of a cylinder attached to linkage 146 or blade 142. In other alternative embodiments, there may be no sensor configured to directly measure a position, velocity, or acceleration of blade 142 or linkage 146.

Blade 142 may be raised or lowered relative to work vehicle 100 by the actuation of lift cylinders 150, which may raise and lower c-frame 148 and thus raise and lower blade 142, which may also be referred to as blade lift. For each of lift cylinders 150, the rod end is pivotally connected to an upward projecting clevis of c-frame 148 and the head end is pivotally connected to the remainder of work vehicle 100 just below and forward of operator station 136. The configuration of linkage 146 and the positioning of the pivotal connections for the head end and rod end of lift cylinders 150 results in the extension of lift cylinders 150 lowering blade 142 and the retraction of lift cylinders 150 raising blade 142. In alternative embodiments, blade 142 may be raised or lowered by a different mechanism, or lift cylinders 150 may be configured differently, such as a configuration in which the extension of lift cylinders 150 raises blade 142 and the retraction of lift cylinders 150 lowers blade 142.

Blade 142 may be tilted relative to work vehicle 100 by the actuation of tilt cylinder 152, which may also be referred to as moving blade 142 in the direction of roll 104. For tilt cylinder 152, the rod end is pivotally connected to a clevis positioned on the back and left sides of blade 142 above the ball-socket joint between blade 142 and c-frame 148 and the head end is pivotally connected to an upward projecting portion of linkage 146. The positioning of the pivotal connections for the head end and the rod end of tilt cylinder 152 result in the extension of tilt cylinder 152 tilting blade 142 to the left or counterclockwise when viewed from operator station 136 and the retraction of tilt cylinder 152 tilting blade 142 to the right or clockwise when viewed from operator station 136. In alternative embodiments, blade 142 may be tilted by a different mechanism (e.g., an electrical or hydraulic motor) or tilt cylinder 152 may be configured differently, such as a configuration in which it is mounted vertically and positioned on the left or right side of blade 142, or a configuration with two tilt cylinders.

Blade 142 may be angled relative to work vehicle 100 by the actuation of angle cylinders 154, which may also be referred to as rotating blade 142 in the direction of yaw 112. For each of angle cylinders 154, the rod end is pivotally connected to a clevis of blade 142 while the head end is pivotally connected to a clevis of c-frame 148. One of angle cylinders 154 is positioned on the left side of work vehicle 100, left of the ball-socket joint between blade 142 and c-frame 148, and the other of angle cylinders 154 is positioned on the right side of work vehicle 100, right of the ball-socket joint between blade 142 and c-frame 148. This positioning results in the extension of the left of angle cylinders 154 and the retraction of the right of angle cylinders 154 angling blade 142 rightward, or yawing blade 142 clockwise when viewed from above, and the retraction of left of angle cylinder 150 and the extension of the right of angle cylinders 154 angling blade 142 leftward, or yawing blade 142 counterclockwise when viewed from above. In alternative embodiments, blade 142 may be angled by a different mechanism or angle cylinders 154 may be configured differently.

Due to the geometry of linkage 146 in this embodiment, blade 142 is not raised or lowered in a perfectly vertical line with respect to work vehicle 100. Instead, a point on blade 142 would trace a curve as blade 142 is raised and lowered. This means that the vertical component of the velocity of blade 142 is not perfectly proportional to the linear velocity with which lift cylinders 150 are extending or retracting, and the vertical component of blade 142's velocity may vary even when the linear velocity of lift cylinders 150 is constant. This also means that lift cylinders 150 have a mechanical advantage which varies depending on the position of linkage 146. Given a kinematic model of blade 142 and linkage 146 (e.g., formula(s) or table(s) providing a relationship between the position and/or movement of portions of blade 142 and linkage 146) and the state of blade 142 and linkage 146 (e.g., sensor(s) sensing one or more positions, angles, or orientations of blade 142 or linkage 146, such as sensor 149), at least with respect to blade lift, controller 138 may compensate for such non-linearity. Incomplete or simplified kinematic models may be used if there is a need to only focus on particular motion relationships (e.g., only those affecting blade lift) or if only a limited compensation accuracy is desired. Controller 138 may utilize this compensation and a desired velocity, for example a command to raise blade 142 at a particular vertical velocity, to issue a command that may achieve a flow rate into lift cylinders 150 that results in blade 142 being raised at the particular vertical velocity regardless of the current position of linkage 146. For example, controller 138 may issue commands which vary the flow rate into lift cylinders 150 in order to achieve a substantially constant vertical velocity of blade 142.

Similarly, due to the positioning of tilt cylinder 152 and angle cylinders 154 and the configuration of their connection to blade 142, the angular velocity of blade tilt and angle is not perfectly proportional to the linear velocity of tilt cylinder 152 and angle cylinders 154, respectively, and the angular velocity of tilt and angle may vary even when the linear velocity of tilt cylinder 152 and angle cylinders 154, respectively, is constant. This also means that tilt cylinder 152 and angle cylinders 154 each has a mechanical advantage which varies depending on the position of blade 142. Much like with lift cylinders 150, given a kinematic model of blade 142 and linkage 146, and the state of blade 142 and linkage 146, at least with respect to blade tilt and angle, controller 138 may compensate for such non-linearity. Incomplete or simplified kinematic models may be used if there is a need to only focus on particular motion relationships (e.g., only those affecting blade tilt and angle) or if only limited compensation accuracy is required. Controller 138 may utilize this compensation and a desired angular velocity, for example a command to tilt or angle blade 142 at a particular angular velocity, to issue commands that may vary the flow rate into tilt cylinder 152 or angle cylinders 154 to result in blade 142 being tilted or angled at the particular angular velocity regardless of the current position of blade 142 or linkage 146.

In alternative embodiments, blade 142 may be connected to the remainder of work vehicle 100 in a manner which tends to make the blade lift velocity (in direction of vertical 110), tilt angular velocity (in the direction of roll 104), or angle angular velocity (in the direction of yaw 112) proportional to the linear velocity of lift cylinders 150, tilt cylinder 152, or angle cylinders 154, respectively. This may be achieved with particular designs of linkage 146 and positioning of the pivotal connections of lift cylinders 150, tilt cylinder 152, and angle cylinders 154. In such alternative embodiments, controller 138 may not need to compensate for non-linear responses of blade 142 to the actuation of lift cylinders 150, tilt cylinder 152, and angle cylinders 154, or the need for compensation may be reduced.

Each of lift cylinders 150, tilt cylinder 152, and angle cylinders 154 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder. The control of these cylinders will be described in further detail with regard to FIG. 2.

Figure 2:
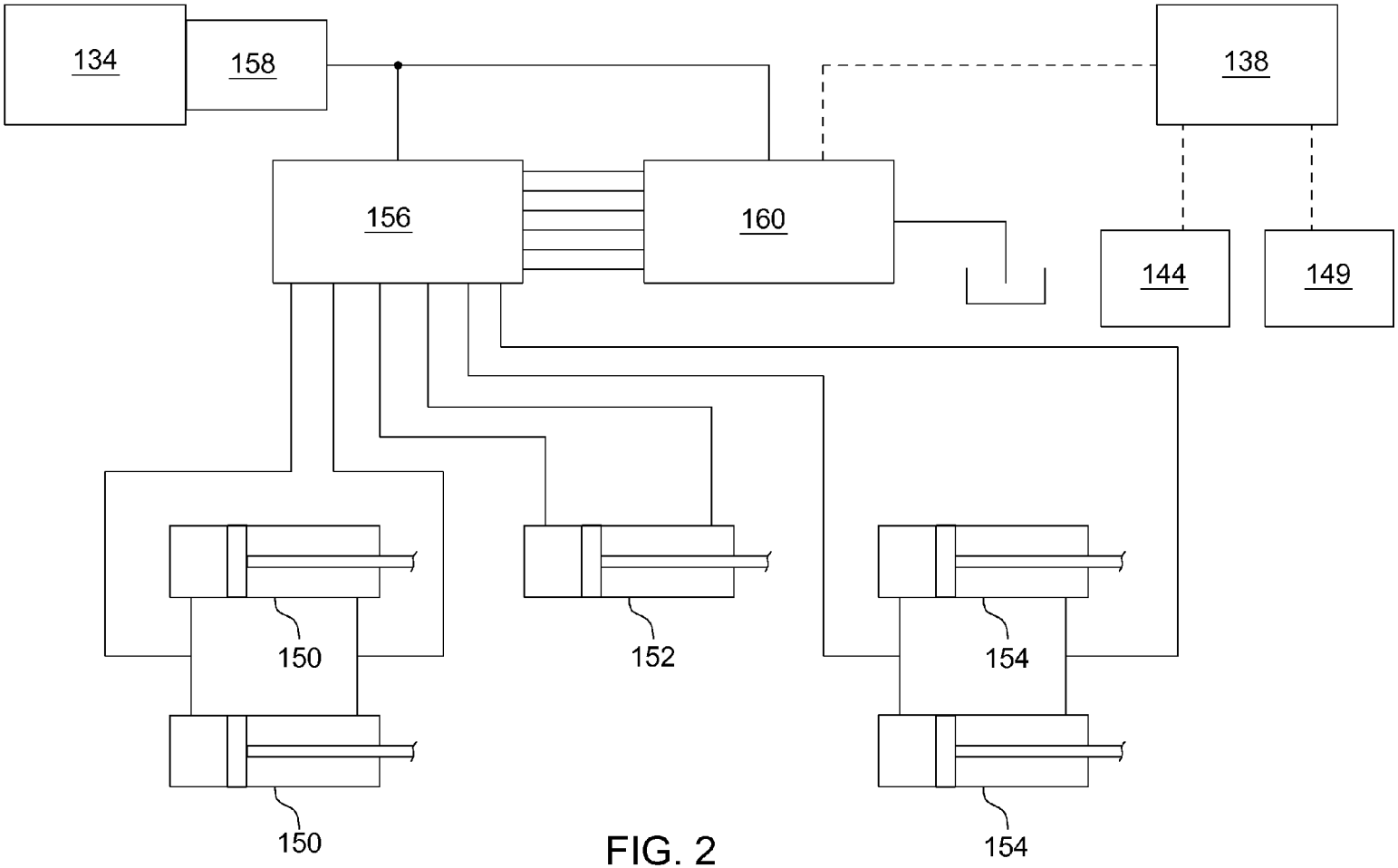
FIG. 2 is a schematic of a portion of the hydraulic and electrical systems of the crawler dozer.

FIG. 2 is a schematic of a portion of a system for controlling the hydraulic cylinder, the system including hydraulic and electrical components. Each of lift cylinders 150, tilt cylinder 152, and angle cylinders 154 is hydraulically connected to hydraulic control valve 156, which may be positioned in an interior area of work vehicle 100. Hydraulic control valve 156 may also be referred to as a valve assembly or manifold. Hydraulic control valve 156 receives pressurized hydraulic fluid from hydraulic pump 158, which may be rotationally connected to engine 134, and directs such fluid to lift cylinders 150, tilt cylinder 152, angle cylinders 154, and other hydraulic circuits or functions of work vehicle 100. Hydraulic control valve 156 may meter such fluid out, or control the flow rate of hydraulic fluid to each hydraulic circuit to which it is connected. In alternative embodiments, hydraulic control valve 156 may not meter such fluid out but may instead only selectively provide flow paths to these functions while metering is performed by another component (e.g., a variable displacement hydraulic pump) or not performed at all. Hydraulic control valve 156 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In the embodiment illustrated in FIG. 1, the spools of hydraulic control valve 156 are shifted by pilots whose pressure is controlled, at least in part, by electrohydraulic pilot valve 160 in communication with controller 138. Electrohydraulic pilot valve 160 is positioned within an interior area of work vehicle 100 and receives pressurized hydraulic fluid from a hydraulic source and selectively directs such fluid to pilot lines hydraulically connected to hydraulic control valve 156. In this embodiment hydraulic control valve 156 and electrohydraulic pilot valve 160 are separate components, but in alternative embodiments the two valves may be integrated into a single valve assembly or manifold. In this embodiment, the hydraulic source is hydraulic pump 158. In alternative embodiments, a pressure reducing valve may be used to reduce the pressure of pressurized hydraulic fluid provided by hydraulic pump 158 to a set pressure, for example 600 pounds per square inch, for usage by electrohydraulic pilot valve 160. In the embodiment illustrated in FIG. 2, individual valves within electrohydraulic pilot valve 160 reduce the pressure from the received hydraulic fluid via solenoid-actuated spools which may drain hydraulic fluid to a hydraulic reservoir. In this embodiment, controller 138 actuates these solenoids by sending a specific current to each (e.g., 600 mA). In this way, controller 138 may actuate blade 142 by issuing electrical commands signals to electrohydraulic pilot valve 160, which in turn provides hydraulic signals (pilots) to hydraulic control valve 156, which shift spools to direct hydraulic flow from hydraulic pump 158 to actuate lift cylinders 150, tilt cylinder 152, and angle cylinders 154. In this embodiment, controller 138 is in direct communication with electrohydraulic pilot valve 160 via electrical signals sent through a wire harness and is indirectly in communication with hydraulic control valve 156 via electrohydraulic pilot valve 160.

Controller 138, which may be referred to as a vehicle control unit (VCU), is in communication with a number of components on work vehicle 100, including hydraulic components such as electrohydraulic pilot valve 160, electrical components such as operator inputs within operator station 136, sensor 144, sensor 149, and other components. Controller 138 is electrically connected to these other components by a wiring harness such that messages, commands, and electrical power may be transmitted between controller 138 and the remainder of work vehicle 100. Controller 138 may be connected to some of these sensors or other controllers, such as an engine control unit (ECU), through a controller area network (CAN). Controller 138 may then send and receive messages over the CAN to communicate with other components on the CAN.

In alternative embodiments, controller 138 may send a command to actuate blade 142 in a number of different manners. As one example, controller 138 may be in communication with a valve controller via a CAN and may send command signals to the valve controller in the form of CAN messages. The valve controller may receive these messages from controller 138 and send current to specific solenoids within electrohydraulic pilot valve 160 based on those messages. As another example, controller 138 may actuate blade 142 by actuating an input in operator station 136. For example, an operator may use a joystick to issue commands to actuate blade 142, and the joystick may generate hydraulic pressure signals, pilots, which are communicated to hydraulic control valve 156 to cause the actuation of blade 142. In such a configuration, controller 138 may be in communication with electrical devices (e.g., solenoids, motors) which may actuate a joystick in operator station 136. In this way, controller 138 may actuate blade 142 by actuating these electrical devices instead of communicating signals to electrohydraulic pilot valve 160.

Figure 3:
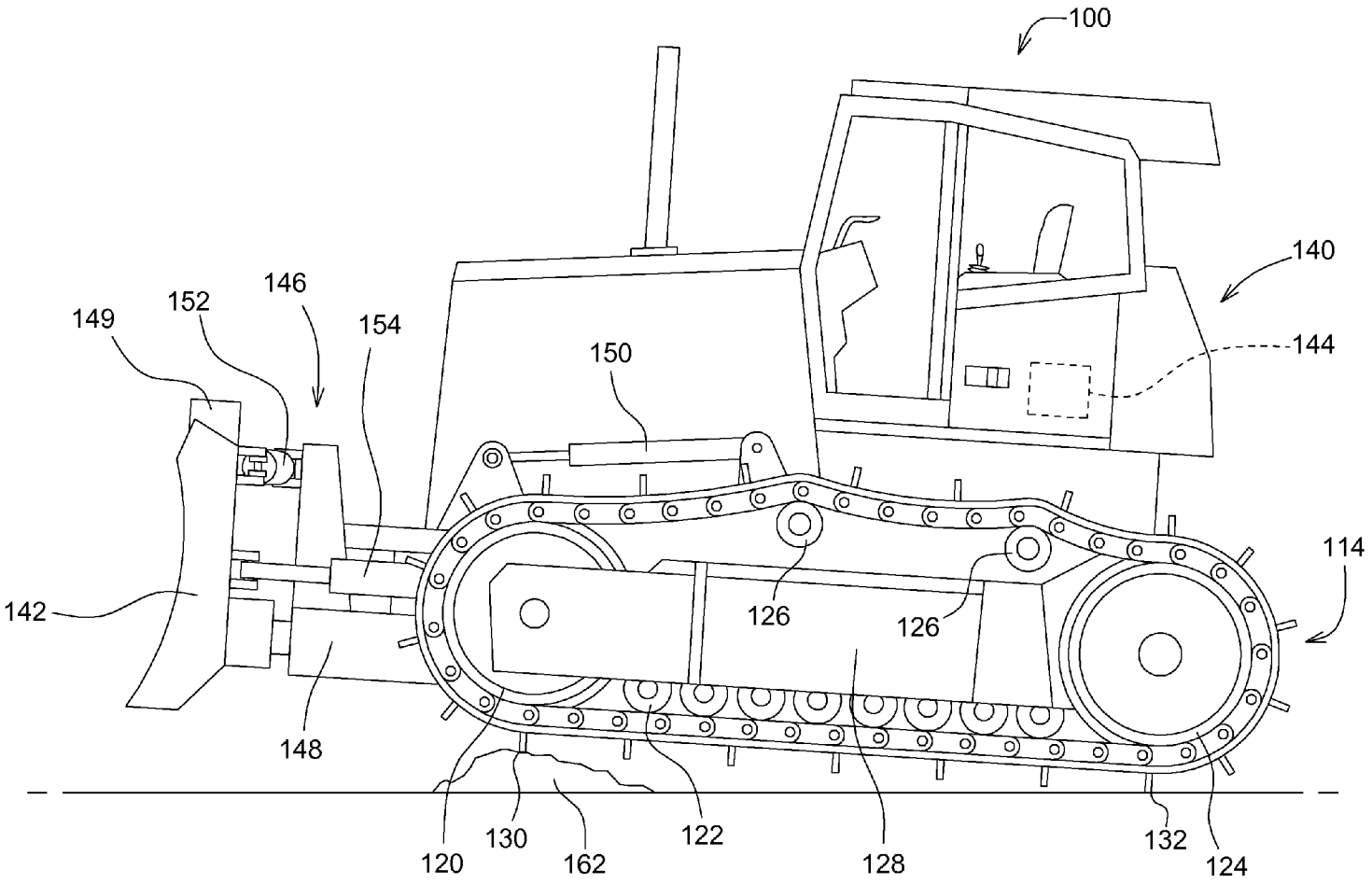
FIG. 3 is a left side view of the crawler dozer driving over a ground feature.

FIG. 3 is a left side view of work vehicle 100 as work vehicle 100 drives over ground feature 162, which in this example is a ground feature at a higher elevation than the surrounding ground surface (e.g., an upward ground feature). As work vehicle 100 drives over ground feature 162, frontmost engaging point 130 is the first point on left track 116 and right track 118 which substantially engages ground feature 162. As work vehicle 100 engages ground feature 162 at frontmost engaging point 130, work vehicle 100 begins to pitch upward or pitch backward as the front of work vehicle 100 rises on ground feature 162 relative to the rear of work vehicle 100. When pitching upwards or backwards, work vehicle 100 will tend to pitch about rearmost engaging point 132. During this pitching, sensor 144 may send a pitch signal indicative of the angular velocity of chassis 140 in the direction of pitch 108. This pitch signal will indicate a velocity in a first direction, pitching upwards, as opposed to indicating a velocity in a second direction, pitching downwards. In this embodiment, the pitch signal from sensor 144 to controller 138 may indicate a value within a range for which values in one half of the range indicate the magnitude of the pitch velocity in the first direction and values in the other half of the range indicate the magnitude of the pitch velocity in the second direction.

As work vehicle 100 continues to drive over ground feature 162, frontmost engaging point 130 would cease to engage the ground and instead would remain suspended above the ground by a distance determined in part by the height of ground feature 162 relative to the surrounding ground surface and the position of work vehicle 100 on ground feature 162. At this point, although ground feature 162 is an upward ground feature, it has the effect of a downward ground feature at a lower elevation than the surrounding ground surface. Specifically, the area just past ground feature 162 is lower than ground feature 162. As the center of gravity for work vehicle 100 passes over the top of ground feature 162, work vehicle 100 will pitch forwards and rearmost engaging point 132 will leave the ground surface while frontmost engaging point 130 will fall until it contacts the ground surface.

During the process of work vehicle 100 driving over ground feature 162, blade 142 will rise and fall relative to the ground surface due to the pitching of work vehicle 100. As work vehicle 100 pitches backward, blade 142 will rise as c-frame 148 pitches backward with work vehicle 100, and as work vehicle 100 pitches forward, blade 142 will fall as c-frame 148 pitches forward with work vehicle 100. If the operator of work vehicle 100 fails to correct for ground feature 162 by commanding blade 142 to rise or fall in a manner that counteracts the effect of ground feature 162 on the height of blade 142, work vehicle 100 will create vertical variations on the ground surface instead of a smooth surface, such as a hill and a valley. As work vehicle 100 drives over this newly created hill and valley on the ground surface, blade 142 will once again be raised and lowered as work vehicle 100 pitches backward and forward, creating further vertical variations. This series of hills and valleys may be referred to as a "washboard" pattern.

While this is occurring, sensor 144 sends a signal indicative of the pitching of chassis 140 to controller 138. Controller 138 may also receive a signal from controls in operator station 138 which the operator may use to issue commands, for example a command to raise or lower blade 142. If controller 138 does not sense a command from the operator to raise or lower blade 142, but receives a pitch signal from sensor 144 indicating that chassis 140 is pitching, controller 138 may issue a command to electrohydraulic pilot valve 160 to raise or lower blade 142 to counteract the effect of pitch from chassis 140. In this manner, controller 138 may attempt to mitigate or attenuate the effect of pitching of chassis 140 on the height of blade 142 and thereby create a smoother ground surface, as further described with regard to FIG. 4, FIG. 5, and FIG. 6.

In this embodiment, each of sensor 144 and sensor 149 comprise three accelerometers, each measuring linear acceleration in one of three perpendicular directions, and three gyroscopes, each measuring angular velocity in one of three perpendicular directions. In this way, sensor 144 and sensor 149 may each directly measure the linear acceleration or angular velocity in any direction, including the directions of longitude 102, latitude 106, vertical 110, roll 104, pitch 108, and yaw 112. The linear acceleration of each accelerometer may be filtered to remove short term accelerations or otherwise analyzed to determine the direction of gravity, which exerts a constant acceleration on sensor 144 and sensor 149. The measurements from the accelerometers and gyroscopes of sensor 144 and sensor 149 may be combined or analyzed together to improve the accuracy and/or reduce the latency with which the direction of gravity may be determined. For example, the accelerometers may measure the direction of gravity with high accuracy over a period of time sufficient to remove the effects of short-term accelerations, while the gyroscopes may measure changes to the direction of gravity very quickly but be subject to drift if these changes are integrated to determine the direction and error is allowed to accumulate.

Figure 4:
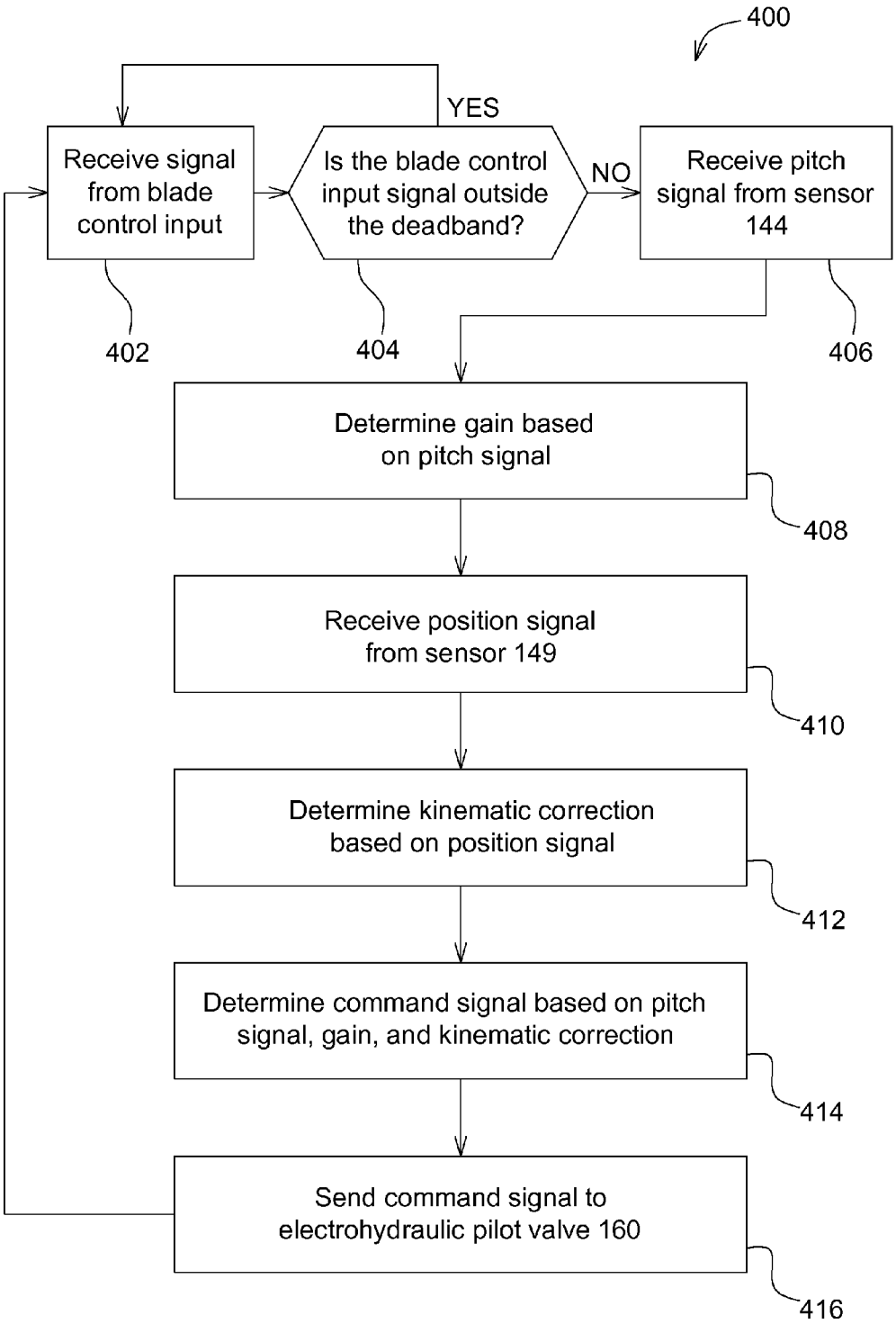
FIG. 4 is a flowchart of a method of actuating a blade of the crawler dozer to create a level surface.

FIG. 4 is a flowchart of control system 400 for actuating blade 142 of work vehicle 100 to create a level ground surface. Control system 400 is implemented on controller 138 of work vehicle 100, and is initiated at the start of work vehicle 100. In alternative embodiments, control system 400 may be initiated by the actuation of an operator control in operator station 136, such as a button or a selection on an interactive display. In step 402, controller 138 receives a signal from a blade control input in operator station 136, such as a joystick that the operator may actuate to issue commands to actuate blade 142. In step 404, controller 138 determines whether the blade control input signal is outside of a deadband by determining whether the signal indicates a command (i.e., blade raise, tilt, or angle) above a threshold. This deadband may be used to avoid unintentional movement of the joystick near it neutral position, which may occur with vibration or work vehicle movement, from being interpreted as a command to actuate blade 142. The size of the deadband, and the corresponding threshold before a command is interpreted as an actual command, may be adjusted and may differ from work vehicle to work vehicle. If controller 138 determines that the blade control input signal is outside of the deadband, controller 138 performs step 402. This loop between step 402 and step 404 effectively suspends control system 400 until the blade control input signal indicates that the operator is not issuing a command.

If the blade control input signal is in the deadband, which indicates that the operator is not issuing a command, controller 138 performs step 406 next. In step 406, controller 138 receives the pitch signal from sensor 144. As an example, controller 138 may receive a CAN message transmitted from sensor 144 to controller 138 via a wire harness. Controller 138 may be programmed to interpret the CAN message to read a value from 1 to 100, where 1 indicates a pitching velocity of 50 degrees a second forward/downward, 100 indicates a pitching velocity of 50 degrees a second backward/upward, and intermediate values indicate intermediate pitching velocities, with a pitching velocity of 0 degrees per second at 50 and 51.

In step 408, controller 138 determines a gain based on whether the pitch signal indicates that chassis 140 is pitching in a first direction (e.g., forwards/downwards) or a second direction (e.g., backwards/upwards). As an example, controller 138 may receive a voltage transmitted from sensor 144 to controller 138 via a wire harness, where a voltage from 0.5-2.5 volts indicates a pitching velocity in the forward/downward direction while a voltage from 2.5-4.5 volts indicates a pitching velocity in the backward/upward direction. Controller 138 may select a first value for the gain, or a first gain, if chassis 140 is pitching forwards/downwards and a second value for the gain, or a second gain, if chassis 140 is pitching backwards/upwards. The value of the gain for each direction of pitching may vary depending on the design of work vehicle 100 and controller 138. For example, the gain may be 4 for a pitching velocity in the forward/downward direction and 2.5 for a pitching velocity in the backward/upward direction.

The value for the first gain and the value for the second gain may be selected based on empirical data for work vehicle 100, the conditions in which work vehicle 100 is operating (e.g., gravel, hard soil, sandy soil), or measurements or characteristics of work vehicle 100 (e.g., hydraulic system responsiveness or speed, weight, length, height, center of gravity), to name but a few possibilities. Additionally, the value of the first gain and second gain may be dependent on each other. As one example, the first gain may be determined for work vehicle 100, and then the second gain may be determined based on the first gain and a characteristic of work vehicle 100. The first gain may be determined based on empirical data for work vehicle 100 or an analogous work vehicle. The second gain may be determined based on the ratio of the longitudinal distance between the rearmost engaging point 132 and blade 142 and the longitudinal distance between the center of gravity for work vehicle 100 and blade 142. This assumes that work vehicle 100 will pitch forwards/downwards approximately about its center of gravity, but will pitch backwards/upwards about an axis closer to rear sprockets 124 when moving in a forward direction.

In alternative embodiments, step 408 may also be based on the direction that work vehicle 100 is traveling. For example, the first gain may be chosen if work vehicle 100 is pitching forwards/downwards and is traveling in a forward direction or if work vehicle 100 is pitching backwards/upwards and is traveling in a reverse direction. Conversely, the second gain may be chosen if work vehicle 100 is pitching backwards/upwards and is traveling in a forward direction or if work vehicle is pitching forwards/downwards and is traveling in a reverse direction.

In alternative embodiments, the gain may also be based on the speed of work vehicle 100 or the magnitude of the pitch signal. For example, the gain may be increased for greater speeds of work vehicle 100 and decreased for lesser speeds of work vehicle 100. As another example, the gain may be increased as the magnitude of the pitch signal increases and decreased as the magnitude of the pitch signal decreases. As another example, the gain may be selected based on a PID (proportional-integral-derivative) control. In these alternate embodiments, the first gain may correspond to a first set of gains or first set of gain constants (e.g., values for PID controller) when work vehicle 100 is pitching forwards/downwards and the second gain may correspond to a second set of gains or second set of gain constants when work vehicle 100 is pitching backwards/upwards.

In step 410, controller 138 may receive a position signal from sensor 149. Sensor 149 may provide a position signal indicating an orientation of blade 142 with respect to the direction of gravity (i.e., inclination). Sensor 149 may provide this signal to controller 138 in the form of a CAN message or a voltage, to name but two possibilities. In alternative embodiments, sensor 149 may be configured to measure any number of angles or positions of blade 142 or linkage 146, including by measuring other components, such as measuring the linear displacement of lift cylinders 150. As an example, sensor 149 may be a rotary position sensor connected in part to chassis 140 and in part to c-frame 148 so as to enable it to measure the angle of linkage 146 relative to chassis 140. As another example, sensor 149 may be a linear displacement sensor connected to one of lift cylinders 150 and configured to measure the extension and retraction of one of lift cylinders 150.

In step 412, controller 138 may determine a kinematic correction based on the position signal from sensor 149. Controller 138 may determine the kinematic correction through the usage of lookup tables or equations, to name but two possibilities. For example, controller 138 may access a lookup table stored in memory which correlates the current position of blade 142 relative to chassis 140 with the sensitivity of blade 142 to movement of lift cylinders 150 (e.g., the ratio of vertical motion of blade 142 to linear motion of lift cylinders 150). This sensitivity may be used to adjust the command signal from controller 138 to achieve a desired vertical velocity. For example, controller 138 may receive a signal from sensor 149 indicating that blade 142 is at an angle of 10 degrees relative to gravity while sensor 144 indicates that chassis 140 is at an angle of 5 degrees relative to gravity, and may determine that the current sensitivity of blade 142 is 0.25 by looking up the difference (+5 degrees) in a lookup table. If it is desired to lower blade 142 at a rate of 100 mm/s, controller 138 may send a command signal to electrohydraulic pilot valve 160 which causes hydraulic control valve 156 to meter hydraulic fluid to lift cylinders 150 so as to cause them to retract at 400 mm/s (100/0.25). This lookup may also be referred to as a pitch-command relationship, as it relates a command necessary to effectuate a particular pitch of the blade. As another example, controller 138 may calculate the sensitivity of blade 142 to movement of lift cylinders 150 based on an equation or a series of equations which describe or approximate the motion of portions of blade 142 or linkage 146.

Figure 5:
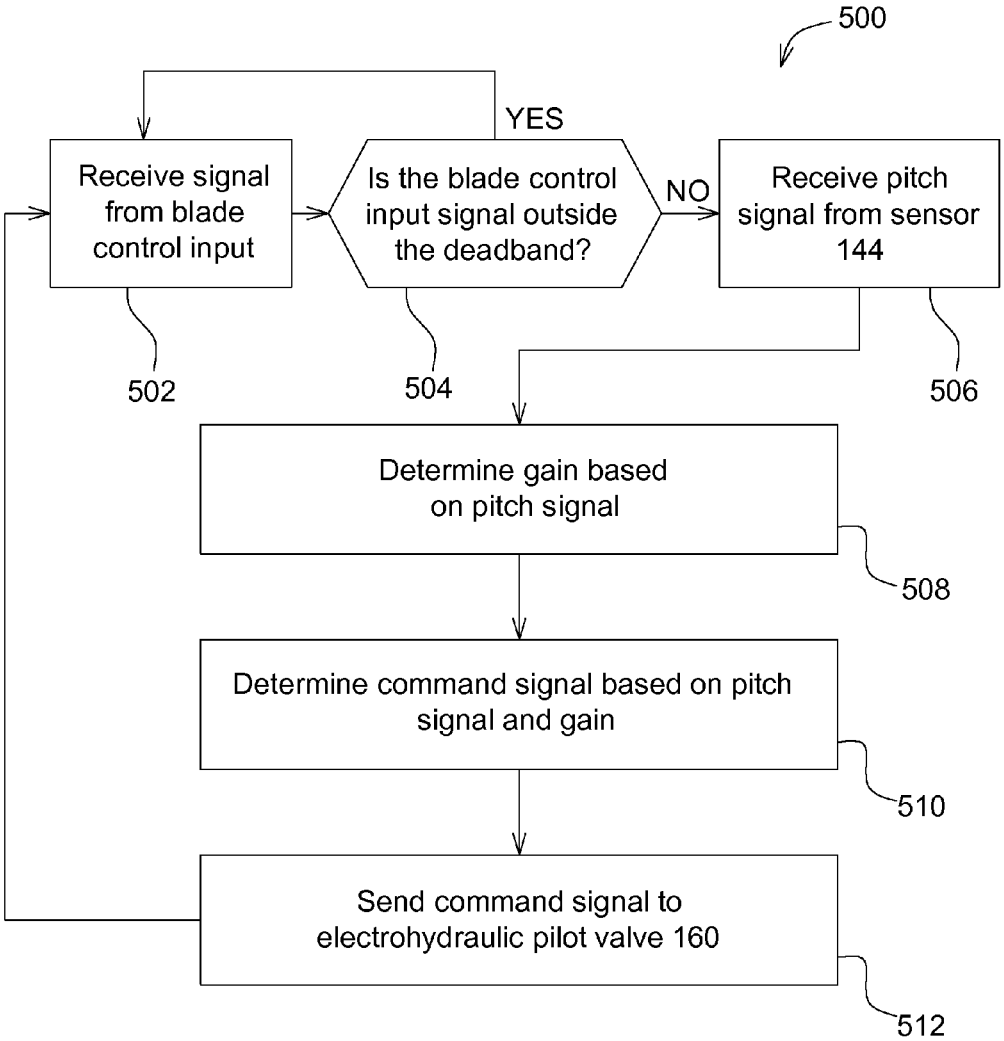
FIG. 5 is a flowchart of another method of actuating the blade of the crawler dozer to create a level surface.

In alternative embodiments, step 410 and step 412 may not be performed and step 414 may be modified so that it does not rely upon kinematic correction, such as in FIG. 5. For some alternative embodiments, the benefits of kinematic correction may not outweigh the additional cost and complexity of measuring the position of blade 142 or linkage 146 and calculating the kinematic correction. In other alternative embodiments, linkage 146 may be designed to mitigate the need for kinematic correction of blade lift commands.

In step 414, controller 138 calculates a command signal based on the pitch signal received in step 406, the gain determined in step 408, and the kinematic correction determined in step 412. In one embodiment, controller 138 may perform this determination by multiplying the pitch signal by the gain and the kinematic correction. In other embodiments, controller 138 may determine the command signal through one or more equations, and may utilize one or more lookup tables in the determination.

In step 416, the command signal determined in step 414 is sent by controller 138 to electrohydraulic pilot valve 160. This command signal may be in the form of a CAN message to another controller which directly controls electrohydraulic pilot valve 160 or may be a current carried by a wire harness directly to a solenoid in electrohydraulic pilot valve 160. This command signal may be used to change the pressure of one or more pilots from electrohydraulic pilot valve 160 to hydraulic control valve 156, and thereby change the metering of hydraulic fluid to a hydraulic function such as lift cylinders 150 to raise or lower blade 142. After step 416, controller 138 may return to step 402 and thereby loop control system 400.

FIG. 5 is a flowchart of control system 500 for actuating blade 142 of vehicle 100, except that it is designed for an alternative embodiment in which vehicle 100 does not include sensor 149. In step 502, controller 138 receives a signal from a blade control input in operator station 136. In step 504, controller 138 determines whether the blade control input signal is outside of a deadband. If controller 138 determines that the blade control input signal is outside of the deadband, controller 138 performs step 502. This loop between step 502 and step 504 effectively suspends control system 500 until the blade control input signal indicates that the operator is not issuing a command. In alternative embodiments, control system 500 may be adjusted so that it also operates when the operator is issuing a command. In such embodiments, control system 500 may sum the operator commands and its pitch corrections to provide a command signal, or it may weight or adjust the operator commands and its pitch corrections to achieve a blended command signal that is not simply the sum of the operator command and the pitch corrections.

If the blade control input signal is in the deadband, which indicates that the operator is not issuing a command, controller 138 may perform step 506 next. In step 506, controller 138 receives the pitch signal from sensor 144. In step 508, controller 138 determines a gain based on whether the pitch signal indicates that chassis 140 is pitching in a first direction (e.g., forwards/downwards) or a second direction (e.g., backwards/upwards). Controller 138 may select a first value for the gain, or a first gain, if chassis 140 is pitching forwards/downwards and a second value for the gain, or a second gain, if chassis 140 is pitching backwards/upwards. In step 510, controller 138 calculates a command signal based on the pitch signal received in step 506 and the gain determined in step 508. Controller 138 performs this determination by multiplying the pitch signal by the gain. In alternative embodiments, controller 138 may determine the command signal through one or more equations, and may utilize one or more lookup tables in the determination.

In step 512, controller 138 sends the command signal determined in step 510 to electrohydraulic pilot valve 160 to change the metering of hydraulic fluid by hydraulic control valve 156 to lift cylinders 150. This may counteract the effect of pitching of chassis 140 on the vertical position of blade 142, and thereby mitigate the effect of such pitching on the smoothness of the surface being worked by work vehicle 100. After step 512, controller 138 may return to step 502 and thereby loop control system 500. The embodiment in FIG. 5 may provide such a correction with only the addition of sensor 144 and the wire harness connecting sensor 144 to controller 138, which may be cheaper, less complex, and/or more robust than other solutions which seek to mitigate the effect of chassis pitching on the smoothness of a grade.

As one example of an application of control system 500, controller 138 may receive a signal from a blade control input and determine that the signal is less than 5% of its maximum value, and therefore within the deadband for that control. Controller 138 may next receive a pitch signal from sensor 144 indicating that chassis 140 is pitching 20 degrees per second in the forward/downward direction. Controller 138 may apply a gain of 4 to pitching in this direction, resulting in a command signal of 80. This command signal may represent a command to raise blade 142 by 80% of the maximum rate it may be raised. This command signal may then be communicated to electrohydraulic pilot valve 160, for example by an electrical current sent by controller 138 via a wiring harness to a solenoid in electrohydraulic pilot valve 160. The command signal of 80 may be converted, for example through the use of a lookup table, to a corresponding electrical current.

Figure 6:
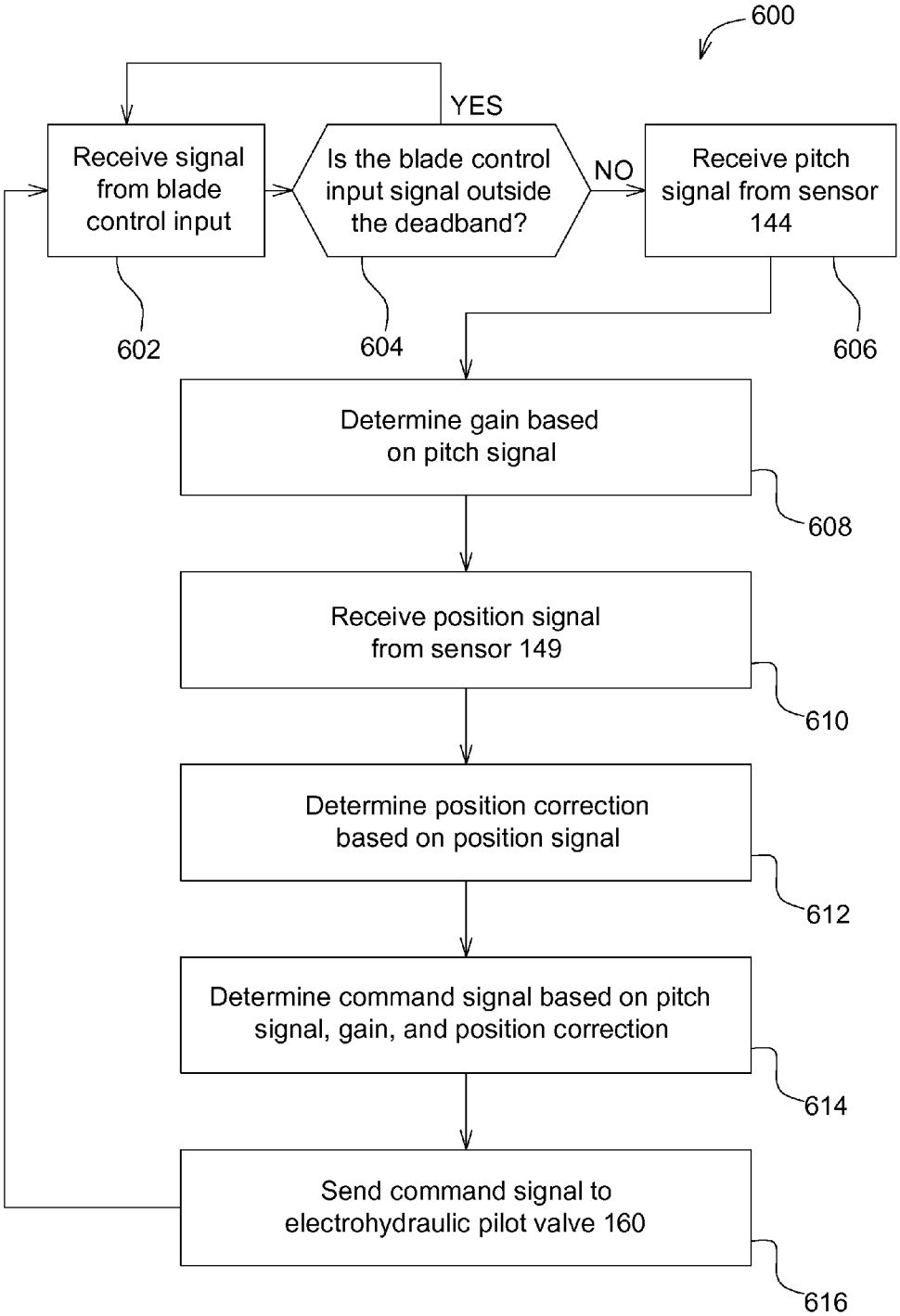
FIG. 6 is a flowchart of another method of actuating the blade of the crawler dozer to create a level surface.

FIG. 6 is a flowchart of control system 600 for actuating blade 142 of vehicle 100. In step 602, controller 138 receives a signal from a blade control input in operator station 136. In step 504, controller 138 determines whether the blade control input signal is outside of a deadband. If controller 138 determines that the blade control input signal is outside of the deadband, controller 138 performs step 602. This loop between step 602 and step 604 effectively suspends control system 600 until the blade control input signal indicates that the operator is not issuing a command.

If the blade control input signal is in the deadband, which indicates that the operator is not issuing a command, controller 138 may perform step 606 next. In step 606, controller 138 receives the pitch signal from sensor 144. In step 608, controller 138 determines a gain based on whether the pitch signal indicates that chassis 140 is pitching in a first direction (e.g., forwards/downwards) or a second direction (e.g., backwards/upwards). Controller 138 may select a first value for the gain, or a first gain, if chassis 140 is pitching forwards/downwards and a second value for the gain, or a second gain, if chassis 140 is pitching backwards/upwards.

In step 610, controller 138 receives a position signal from sensor 149. This position signal may be in the form of a CAN message which indicates the inclination of blade 142, or the angle of blade 142 with respect to the direction of gravity. Sensor 149 may determine this inclination through the use of accelerometers which measure the direction of gravity and then calculating the angle of sensor 149 relative to that direction.

In step 612, controller 138 determines a position correction based on the position signal received in step 610. As control system 600 performs corrections to mitigate the effects of the pitching of chassis 140 on the grade produced by blade 142, the position of blade 142 may drift from its initial position due to such corrections. In step 612, controller 138 may determine whether the position of blade 142 needs to be corrected, and if so by what amount. In this embodiment, controller 138 may compare the position of blade 142 received in step 610 with the position of blade 142 at the time that the operator last issued a blade control input outside the deadband. This last-commanded position may be stored by controller 138 when step 604 indicates that the blade control input signal is outside the deadband. Controller 138 may then calculate a position correction based on the comparison, which in this embodiment may be done by multiplying the difference between the current position of blade 142 and the last-commanded position of blade 142 by a gain. In alternative embodiments, other methods of determining a position correction may be employed, including by using a PID (proportional-integral-derivative) control, equations, variable gains, or lookup tables.

In step 614, controller 138 calculates a command signal based on the pitch signal received in step 606, the gain determined in step 608, and the position correction determined in step 612. Controller 138 performs this determination by multiplying the pitch signal by the gain and adding the position correction. In alternative embodiments, controller 138 may determine the command signal by multiplying all three values or through the use of one or more equations and/or lookup tables.

In step 616, controller 138 sends the command signal determined in step 614 to electrohydraulic pilot valve 160 to change the metering of hydraulic fluid by hydraulic control valve 156 to lift cylinders 150. After step 616, controller 138 may return to step 602 and thereby loop control system 600. Control system 600 may counteract the effect of pitching of chassis 140 on the vertical position of blade 142, and thereby mitigate the effect of such pitching on the smoothness of the surface being worked by work vehicle 100, while also eventually returning blade 142 to the vertical position it held at the time of the last operator command.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

a chassis;

a ground-engaging blade movably connected to the chassis via a linkage configured to allow the blade to be raised or lowered relative to the chassis;

a sensor connected to the chassis at a fixed relative position to the chassis and configured to provide a pitch signal indicative of a rotational velocity in a pitch direction; and a controller configured to:

receive the pitch signal; and send a command to raise or lower the blade, the command based on a first gain and the pitch signal when the pitch signal indicates rotational velocity in a first direction, the command based on a second gain and the pitch signal when the pitch signal indicates rotational velocity in a second direction.

2. The work vehicle of claim 1, wherein the command is based on a pitch-command relationship, the pitch-command relationship based on kinematics of the linkage.

3. The work vehicle of claim 1, further comprising a hydraulic cylinder and a hydraulic valve, wherein the hydraulic cylinder is connected to the linkage, the hydraulic cylinder is configured to raise or lower the blade when provided with hydraulic fluid from the hydraulic valve, the command is based on a pitch-command relationship, and the pitch-command relationship is based on a relationship between the command and a flow rate from the hydraulic valve to the hydraulic cylinder.

4. The work vehicle of claim 1, wherein the first direction is the chassis pitching forward, the second direction is the chassis pitching backward, and the magnitude of the first gain is greater than the magnitude of the second gain.

5. The work vehicle of claim 4, further comprising ground-engaging tracks connected to the chassis, wherein a ratio of the first gain to the second gain is substantially the same as a ratio of a longitudinal distance from a rearmost ground-engaging portion of the tracks to the blade to a longitudinal distance from the center of gravity of the work vehicle to the blade.

6. The work vehicle of claim 4, further comprising ground-engaging tracks connected to the chassis, wherein a ratio of the first gain to the second gain is between 80% and 120% of a ratio of a longitudinal distance from the rearmost portion of the tracks engaged with the ground to the blade to a longitudinal distance from the center of gravity of the work vehicle to the blade.

7. The work vehicle of claim 1, wherein the command is not based on a signal from a sensor directly connected to the blade and configured to provide a signal indicative of a rotational velocity of the blade.

8. The work vehicle of claim 1, further comprising a blade sensor connected to the blade at a fixed relative position to the blade, wherein the blade sensor is configured to provide a position signal indicative of a vertical position of the blade or an angle of the blade relative to the direction of gravity, the command is based on the first gain, the pitch signal, and the position signal when the pitch signal indicates rotational velocity in the first direction, and the command is based on the second gain, the pitch signal, and the position signal when the pitch signal indicates rotational velocity in a second direction.

* * * * *